US006526784B2

(12) United States Patent
Machida et al.

(10) Patent No.: US 6,526,784 B2
(45) Date of Patent: Mar. 4, 2003

(54) ACTUATOR IN A NEEDLE-SELECTING APPARATUS FOR A KNITTING MACHINE

(75) Inventors: Toyoji Machida, Hyogo (JP); Wataru Awata, Hyogo (JP); Makio Miyamoto, Hyogo (JP); Sumikazu Tsuchitani, Hyogo (JP); Kazuyuki Zenio, Hyogo (JP)

(73) Assignee: Mitsu Tec Co., Ltd., Hyogo (JP)

( * ) Notice: Subject to any disclaimer, the term of this patent is extended or adjusted under 35 U.S.C. 154(b) by 0 days.

(21) Appl. No.: 10/022,201

(22) Filed: Dec. 20, 2001

(65) Prior Publication Data

US 2002/0078716 A1 Jun. 27, 2002

(30) Foreign Application Priority Data

Dec. 27, 2000 (JP) ..... 2000-398243
Nov. 16, 2001 (JP) ..... 2001-351823

(51) Int. Cl.[7] ..... D04B 16/78
(52) U.S. Cl. ..... 66/218
(58) Field of Search ..... 66/215, 218, 216, 66/219, 220, 221

(56) References Cited

U.S. PATENT DOCUMENTS 3,961,501 A * 6/1976 Martinetz ..... 66/218
5,027,619 A * 7/1991 Saito ..... 66/218
5,823,015 A * 10/1998 Shibata ..... 66/205
6,220,062 B1 * 4/2001 Enomoto et al. ..... 66/218

FOREIGN PATENT DOCUMENTS

| | | |
|---|---|---|
| DE | 39 33 149 A | 4/1990 |
| EP | 0 964 092 A | 12/1999 |
| EP | 0 974 692 A | 1/2000 |
| EP | 1 018 571 A | 7/2000 |
| GB | 1 556 792 A | 11/1979 |

* cited by examiner

*Primary Examiner*—Danny Worrell
(74) *Attorney, Agent, or Firm*—Bacon & Thomas

(57) ABSTRACT

The tip (26*a*) of a rear-end mount (26) that fastens the piezoelectric element (6) is tapered. The rearmost part (26*b*) of the rear-end mount (26) that fastens the piezoelectric element (6) is indented in a U shape. An eccentric pin (30), which extends in the direction perpendicular to the longitudinal direction of the piezoelectric element (6), is fitted in this indentation. The rear-end mount (42), which fastens one end of the finger (8), is provided with a pin (46) that extends in the direction perpendicular to the longitudinal direction of the piezoelectric element (6). This pin (46) is provided with a spiral groove (48) over practically its entire length.

8 Claims, 6 Drawing Sheets

ACTUATOR IN A NEEDLE-SELECTING APPARATUS FOR A KNITTING MACHINE

FIELD OF THE INVENTION

The present invention relates to a needle-selecting apparatus for a knitting machine; in particular, a needle-selecting actuator that activates a piezoelectric finger for needle selection.

PRIOR ART

In a pattern-knitting machine such as a pattern-knitting circular knitting machine and a pattern-knitting flat knitting machine, a needle-selecting apparatus is used to transmit the pattern-forming procedure stored in a memory device such as a pin drum, tape or floppy disk to a vertical motion of the knitting needle. As an example of such a needle-selecting apparatus, a needle-selecting apparatus for a knitting machine using an electromagnet is known. Due to the functional limitations of the electromagnet, however, there is a limit to how fast the machine can respond. An increase in speed is accompanied by a higher temperature, increased power consumption and an increase in the size of the needle-selecting apparatus itself.

As a variation of this type of needle-selecting apparatus, a piezoelectric needle-selecting apparatus that applies a voltage to a piezoelectric element to operate a finger and thereby select a needle is proposed. According to this piezoelectric needle-selecting apparatus, in an actuator in which the tip of a piezoelectric element that is pasted on both sides of a plate is provided with a finger, an electric voltage is applied to the piezoelectric element via a lead wire, and said finger is operated in such a way that it follows the movement of the piezoelectric element, thereby engaging or disengaging the butt (finger butt) with or from the needle-selecting jack, which is arranged so as to maintain contact with the lower end of the knitting needles.

When a pulse is not applied to the piezoelectric element of the actuator (or when a negative pulse is applied), the tip of the finger comes into contact with the butt (peg) of a jack (or a knitting needle itself) and exerts pressure on the jack. As a result, the butt for raising a cam at the lower end of the jack cannot engage the raising cam, therefore the jack and the knitting needle that comes into contact with the upper part thereof do not undergo a vertical motion. In this case, the knitting needle does not form stitches.

On the other hand, when a pulse is applied to the piezoelectric element of the actuator, thereby causing the piezoelectric element to bend, the tip of the finger does not come within the moving locus of the butt of the jack. The jack, therefore, maintains its perpendicular position. As a result, the butt for the raising cam at the lower end of the jack engages the raising cam, moving the jack and the knitting needle that comes into contact with the jack vertically. In this case, stitches are made by the knitting needle.

Using this piezoelectric needle-selecting apparatus, needles can be selected much faster than in the case of a needle-selecting machine using an electromagnet. The response is quick, and it is possible to apply a higher-cycle pulse. Other benefits include lower power consumption compared with a needle-selecting apparatus using an electromagnet and a significant reduction in the size of the needle-selecting apparatus itself In such a piezoelectric needle-selecting apparatus, one end of the length of the piezoelectric element is fixed in a cantilevered fashion so as to allow the piezoelectric element to perform a motion. But under the cantilevered method of holding a piezoelectric element, increasing the response speed by applying a high-cycle pulse to the piezoelectric element can make the needle-selecting motion less stable. Moreover, if a ceramic material is used for the piezoelectric element, because ceramic materials are brittle, the piezoelectric element can be damaged by high-speed vibrations.

In order to solve these problems, a method for supporting a piezoelectric element at two points (JP-A-6-169116, <1994>) and a method for supporting a piezoelectric element at three points (JP-A-5-302251, <1993>) have been proposed and products based on these ideas are commercially available.

Although it is not apparent from the above publications, the currently available products embodying either of the above patents have fingers that are arranged in a cross-stitched fashion in one row and sixteen stages. As a result, the housing volume has to be large enough to house many stages of fingers, the needles have to be long and two butts need to be established.

The inventors of the present invention have conceived the idea of arranging fingers in two rows and eight stages so that the fingers can be housed in a lower-profile housing, making the whole apparatus more compact. If the height of the housing is small, the needles can be short, and if there are two rows, only one butt suffices. But to ensure the previous level or a higher level of performance using this configuration, a thick piezoelectric element has to be used, and thick piezoelectric elements are prone to breakage as the voltage becomes higher.

SUMMARY OF THE INVENTION

The objective of the present invention, therefore, is to improve on the piezoelectric element and its peripherals in a conventional needle-selecting apparatus having a piezoelectric element held in a cantilevered fashion, thereby providing an actuator for needle-selection that is even better than those based on the above-mentioned two-point or three-point support methods.

The present invention is characterized in that, in an actuator using a piezoelectric element in a needle-selecting apparatus for a knitting machine, in which one end of the length of the piezoelectric element is fixed in a cantilevered fashion, a voltage is applied to said piezoelectric element to cause it to move, and the motion is transmitted to a finger that is attached to the forward part of the piezoelectric element, the piezoelectric element has a rear-end mount with its front part tapered towards the piezoelectric element.

Thanks to this configuration, the piezoelectric element does not lose its resilience or flexibility even after repeated bending motions. As a result, the frequency for breakage of the piezoelectric element is reduced. Other advantages are that a thick piezoelectric element can be used, and the height of the housing can be made smaller. By arranging the fingers in two rows and eight stages, the volume of the housing can be reduced by approximately 35% compared with currently sold products.

Preferably, the rear-end mount consists of a front part and a rear part. The front part is made of synthetic resin and is smoothly and linearly tapered towards the piezoelectric element. Preferably, a shallow groove extends between the rear part and the front part of the rear-end mount in the direction perpendicular to the longitudinal direction of the piezoelectric element. The synthetic resin preferably has a hardness of D55 to D85.

The present invention is also characterized in that, in an actuator using a piezoelectric element in a needle-selecting apparatus for a knitting machine, in which one end of the length of the piezoelectric element is fixed in a cantilevered fashion, a voltage is applied to said piezoelectric element to cause it to move, and the motion is transmitted to a finger that is attached to the forward part of the piezoelectric element, the piezoelectric element is fixed to a rear-end mount whose rearmost part is provided with a U-shaped indentation, and in this indentation, an eccentric pin that extends in the direction perpendicular to the longitudinal direction of the piezoelectric element is fitted.

Thanks to this configuration, the angle of the rear-end mount can be adjusted by adjusting the engagement of the eccentric pin and the U-shaped indentation. The position of the rear-end mount can be finely adjusted for a selection of the optimized bending motion. As a result, it is possible to obtain an even vibration amplitude, which leads to a stable finger action and fewer instances of breakage of the piezoelectric element.

The present invention is also characterized in that, in an actuator using a piezoelectric element in a needle-selecting apparatus for a knitting machine, in which one end of the length of the piezoelectric element is fixed in a cantilevered fashion, a voltage is applied to said piezoelectric element to cause it to move, and the motion is transmitted to a finger that is attached to the forward part of the piezoelectric element, one end of the finger is fixed via a pin which is engraved with a spiral groove over practically its entire length.

In this configuration, the spiral groove has functions of preventing friction between the finger and the contact surface, facilitating lubrication and removing foreign matter.

Preferably, the rear-end mount of the finger has a rearmost end provided with a U-shaped indentation, and the piezoelectric element has a front-end mount with its tip press-fitted to this indentation.

The present invention is also characterized in that, in an actuator using a piezoelectric element in a needle-selecting apparatus for a knitting machine, in which one end of the length of the piezoelectric element is fixed in a cantilevered fashion, a voltage is applied to said piezoelectric element to cause it to move, and the motion is transmitted to a finger that is attached to the forward part of the piezoelectric element, the housing that houses this actuator is equipped with a ribbed air-cooling device.

Thanks to this configuration, the temperature of the substrate for driving the piezoelectric element of the actuator can be lowered by approximately 15° C., resulting in a reduced frequency of malfunctions and failures of the apparatus.

The present invention is also characterized in that, in an actuator using a piezoelectric element in a needle-selecting apparatus for a knitting machine, in which one end of the length of the piezoelectric element is fixed in a cantilevered fashion, a voltage is applied to said piezoelectric element to cause it to move, and the motion is transmitted to a finger, which is attached to the forward part of the piezoelectric element, at least two unpenetrated tapping holes are provided at a rear wall.

Thanks to this configuration, the rear wall can be lifted by screwing a screw into each tapping holes.

BRIEF DESCRIPTION OF THE DRAWINGS

Examples of the present invention will now be described by reference to the accompanying drawings, in which.

EXAMPLES

Figure 1:
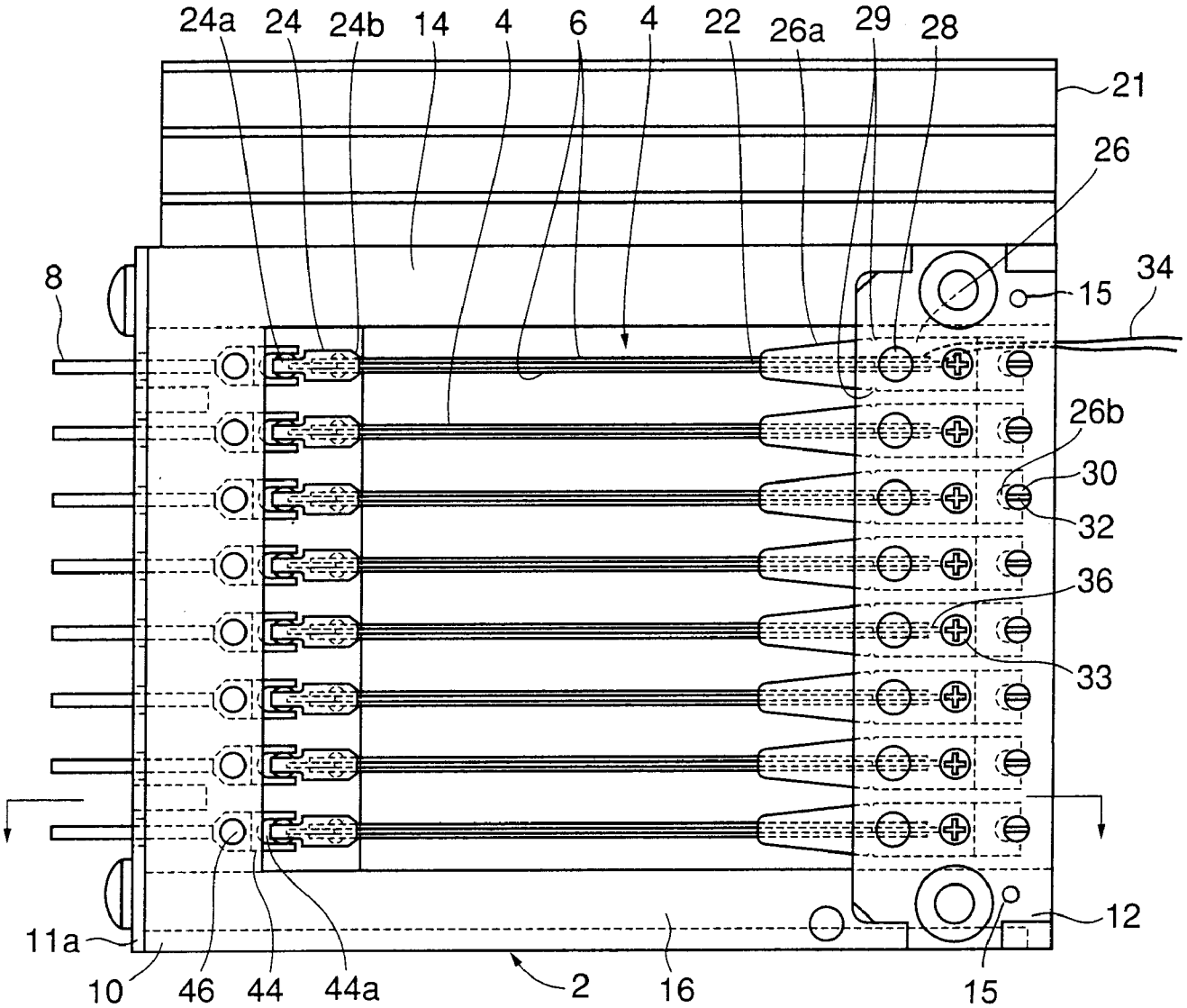
FIG. 1 is a side view of a needle-selecting apparatus of the present invention.

As shown in FIGS. 1–5, the needle-selecting apparatus 2 comprises several actuators 4 and a housing that houses these actuators 4. The actuators 4 are arranged vertically (in the axial direction of the rotary cylinder of the circular knitting machine) in two rows and eight stages with a space between each actuator. Each actuator 4 comprises a piezoelectric element 6, resin parts (described later), which hold the front and rear of the piezoelectric element, and a finger 8, which is positioned in the forward part of the piezoelectric element 6.

The housing is formed in a rectangular shape with a front wall 10, a rear wall 12, an upper wall 14 and a lower wall 16. FIG. 1 shows a condition in which the side cover (not shown) is removed, so the inside is visible from the side. The rear wall 12 supports the rear-end mount 26 of each piezoelectric element. Front covers 11, 11*a*, which form a part of the front wall 10, are provided with an opening 20 (FIG. 3) for the fingers 8 to project through. The opening 20 has a groove 20*a* having a width that corresponds to the vertical stroke of the fingers 8. To fix the positions of the front covers 11, 11*a*, several knock pins 13 are provided.

On top of the rectangular housing, a heat-radiator 21 is established in such a way as to form a part of the housing. When attaching the housing to the knitting machine, a rubber sheet (e.g., a silicon heat-radiating sheet, not shown) is installed on the heat-radiator 21 to improve heat conduction and to insulate the housing from the feeder device.

The piezoelectric element 6 of the actuator 4 is pasted on the upper and lower sides of a center shim plate 22. The piezoelectric element 6 is a band-shaped ceramic made by baking barium titanate, for example, and has an inverted piezoelectric effect.

The tip of the piezoelectric element 6 terminates just in front of the front wall 10 of the housing, and is covered with a front-end mount 24 made, for example, of Hytrel (brand name of Dupont-Toray Co., Ltd.), which is a polyester thermoplastic elastomer resin formed by the insert forming method. The front-end mount 24 comprises a thin edge 24*a* and a base 24*b* behind said edge 24*a*.

Figure 6:
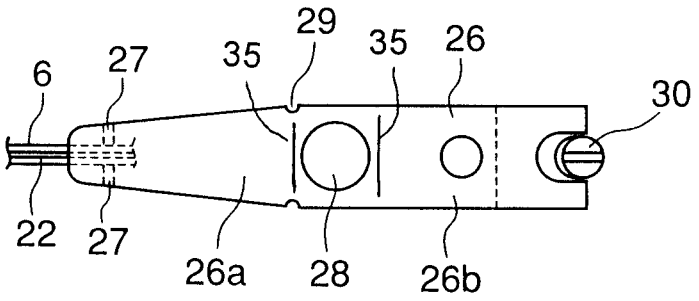
FIG. 6 is an enlarged side view of the rear-end mount of the piezoelectric element of the needle-selecting apparatus of the present invention.
Figure 6:
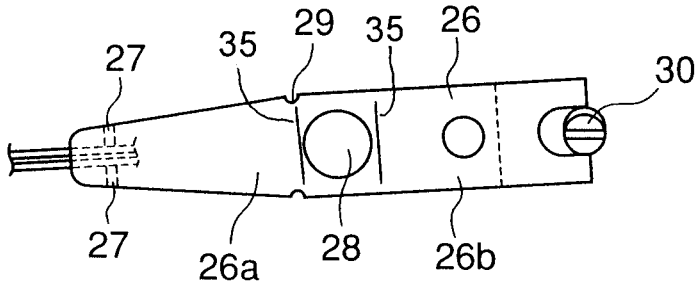

The rear end of the piezoelectric element 6 is covered and housed inside the rear-end mount 26, which is made, for example, of Hytrel (brand name), a resin formed by the insert forming method. When a voltage is applied, the piezoelectric element 6 can perform a bending motion in the direction perpendicular to the longitudinal direction using a first pin 28, which runs through the rear-end mount 26 from left to right (in the direction perpendicular to the longitudinal direction of the piezoelectric element), as a fulcrum. As shown in FIG. 6, it is preferable that the front part 26*a* of the first pin 28 is longer than the rear part 26*b*. The first pin 28 is supported by the rear wall 12 of the housing.

One of the characteristics of the present invention is the synthetic resin used in the rear-end mount 26. Various types of thermoplastic elastomer resin can be used; for example, urethane, ester amid, ethylene, fluoride, homopolymer, ionomer, etc. Such resin is preferably has a hardness of D55 to D85.

Another characteristic of the present invention is that the front part 26*a* of the rear-end mount 26 is tapered towards the piezoelectric element 6. It is particularly preferable that it is tapered smoothly and linearly when viewed from the side (FIG. 1, FIG. 6 (*a*) (*b*)). The tapered part is preferably 7–10 mm long and inclined at an angle of 5–10°, and most preferably, 7–8°. Thanks to this configuration, the piezoelectric element does not lose its resilience and flexibility even after repeated bending motions, and as a result, it is possible to reduce the frequency of breakage of the piezoelectric element.

Figure 2:
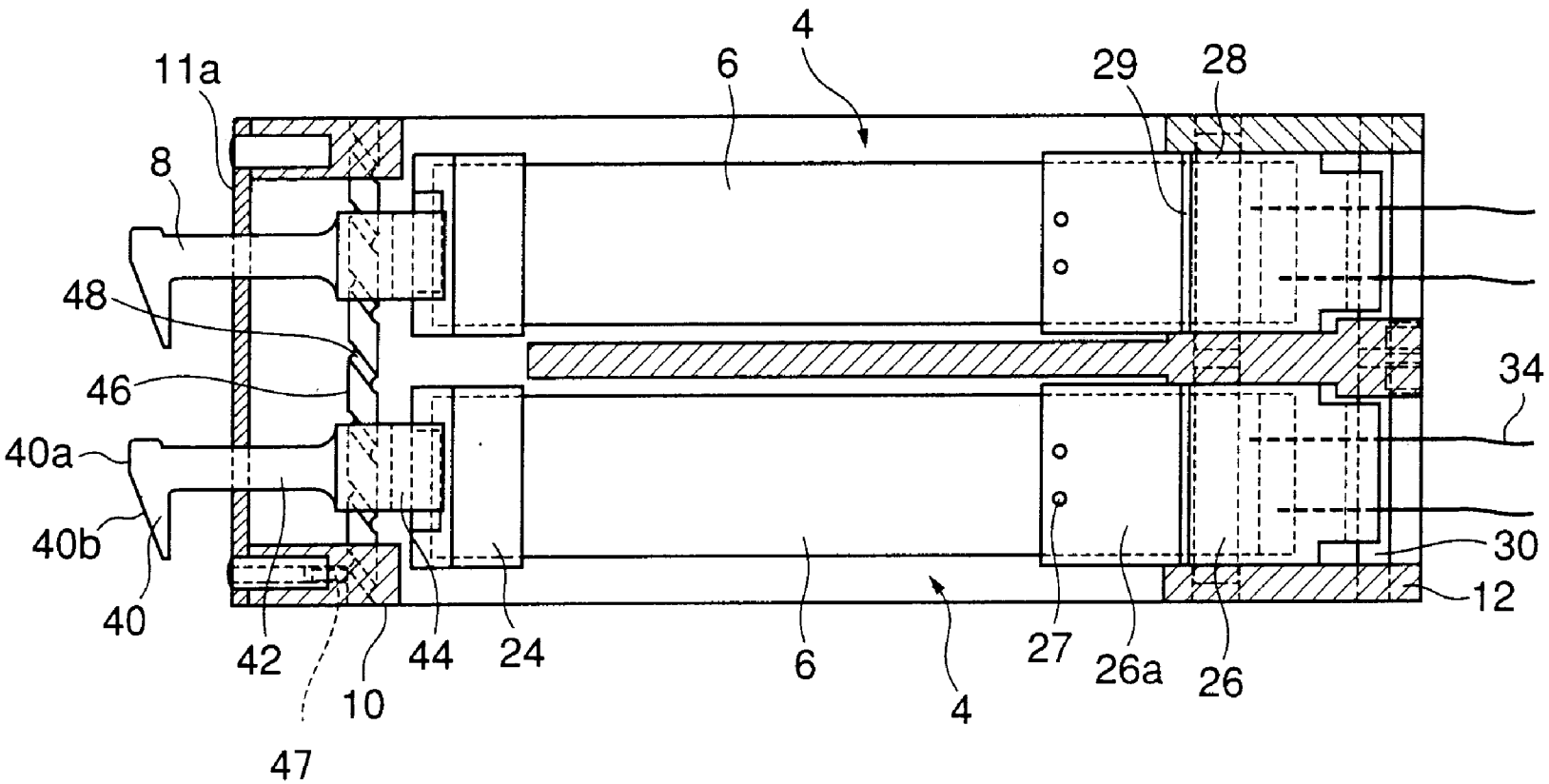
FIG. 2 is a cross-sectional view taken along line 2—2 of FIG. 1.
Figure 3:
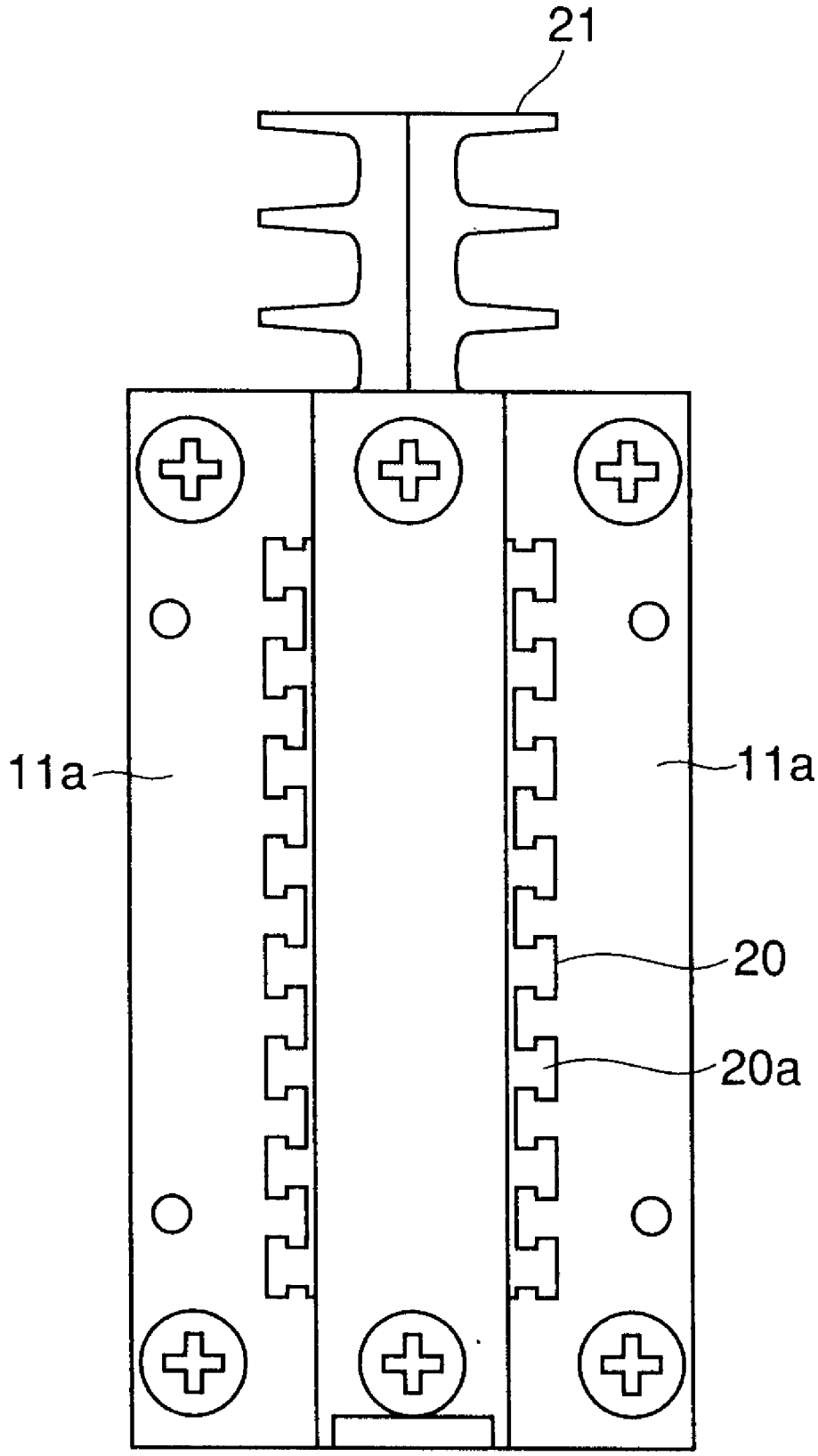
FIG. 3 is a side view from the left-hand side of the needle-selecting apparatus of the present invention with all fingers removed.
Figure 4:
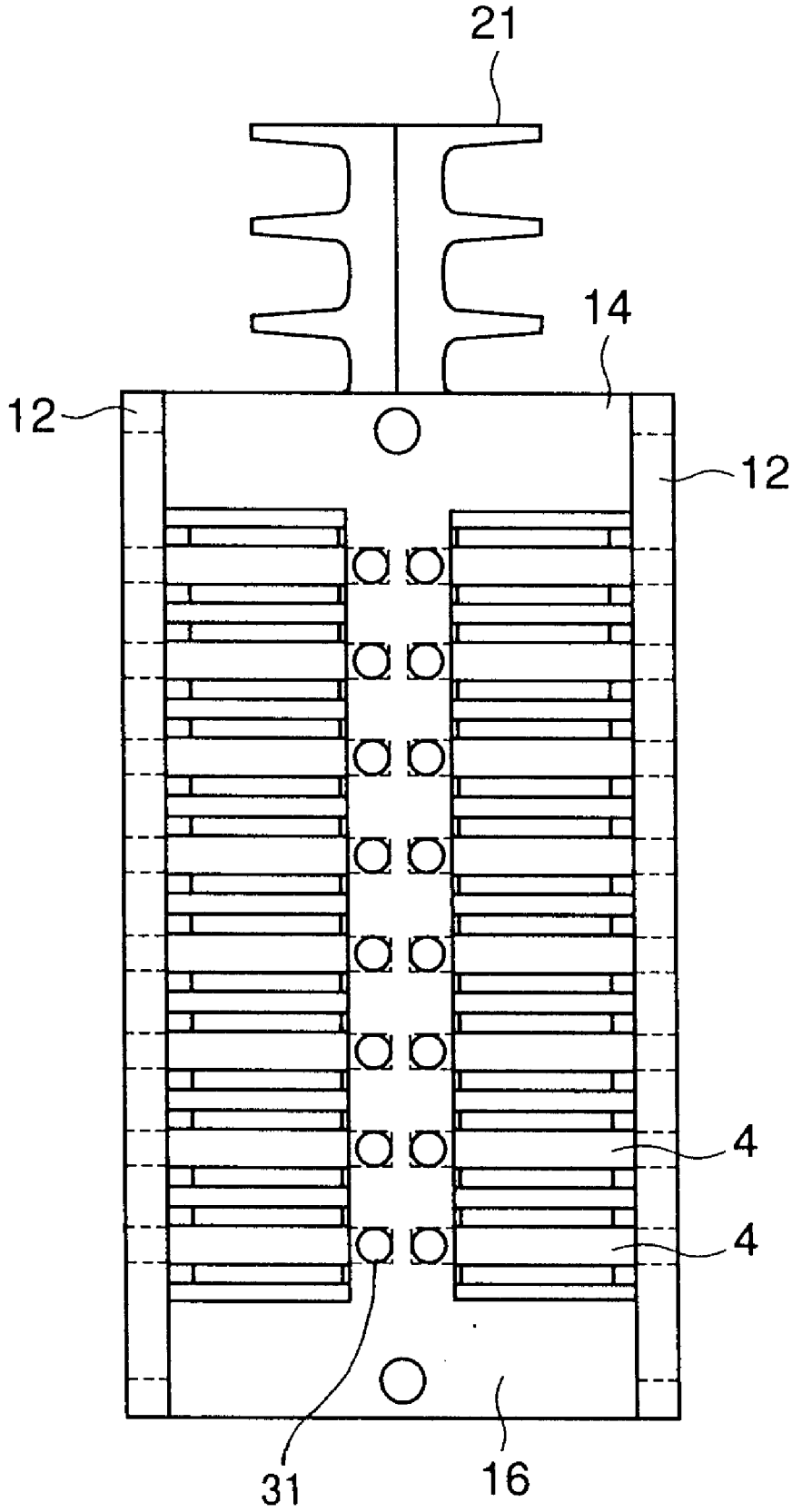
FIG. 4 is a side view from the right-hand side of the needle-selecting apparatus of the present invention with all wires removed.
Figure 5:
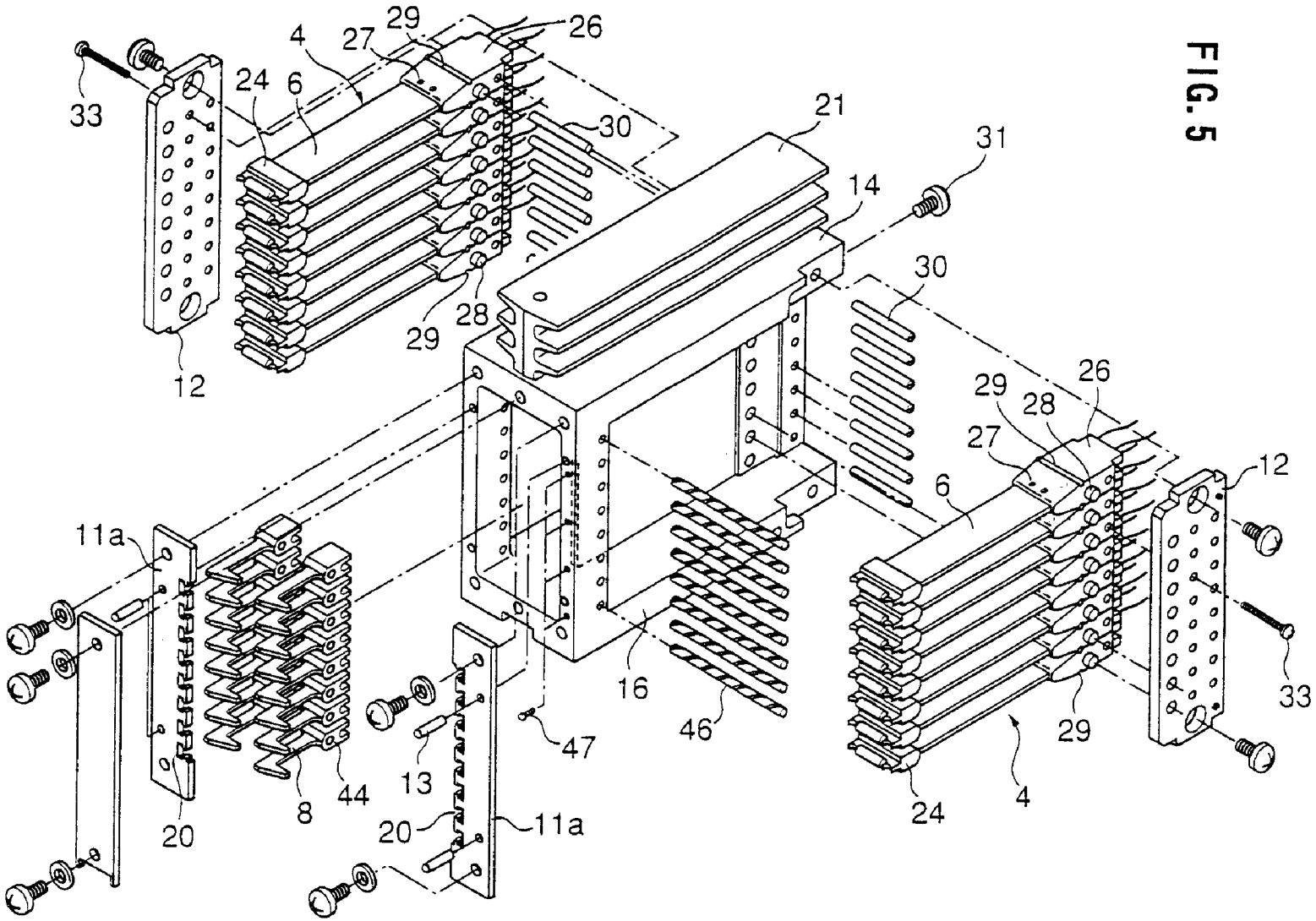
FIG. 5 is an exploded perspective view of the needle-selecting apparatus of the present invention.

As shown in FIGS. 2 and 6, the top and bottom of the part that separates the front part 26*a* from the rear part 26*b* of the rear-end mount 26 are respectively provided with a shallow groove 29 running in the direction perpendicular to the longitudinal direction. It is preferable to inject adhesive between the front part 26*a* and the piezoelectric element 6 so that the joint is sufficiently strong. Adhesive is injected through an injection hole 27 (see FIGS. 2, 5, 6 and 7) provided in the front part 26*a*.

Furthermore, it is preferable to provide protruded lines 35 at the left and right sides of the first pin 28 running in the direction perpendicular to the longitudinal direction. The actuator 4 is supported at one side, and sandwiched by the front wall 10 and the rear wall 12. However, it is difficult to cramp a plurality of actuators 4 evenly. The protruded lines 35 are crashed depending on the cramping force applied to the front and rear walls 10, 12, thereby stabilizing the actuator 4.

Figure 7:
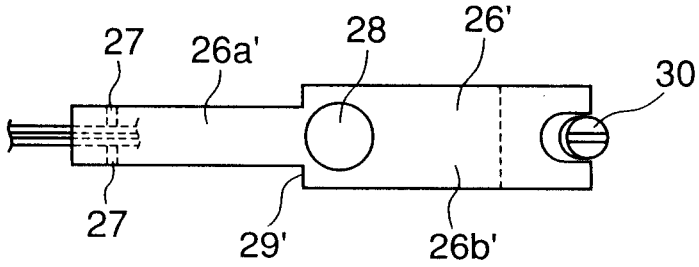
FIG. 7 is an enlarged side view of another example of the rear-end mount of the piezoelectric element of the needle-selecting apparatus of the present invention.
Figure 8:
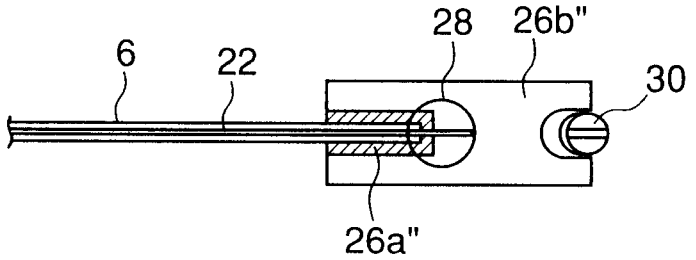
FIG. 8 is an enlarged side view of yet another example of the rear-end mount of the piezoelectric element of the needle-selecting apparatus of the present invention.

Although less effective than the linearly tapered shape, the front part can also be formed in a thin, flat shape having notches as shown in FIG. 7. Also, as shown in FIG. 8, the rear end of the piezoelectric assembly can be sandwiched in two layers with soft internal resin 26" and hard external resin 26*b*". The soft resin 26*a*" preferably has a hardness of D40–55, and most preferably D50. The hard external resin 26*b*" preferably has a hardness of D80–95, and most preferably D90. In this case, the rear end of the shim plate in the center of the piezoelectric element is preferably extended to the hard resin 26*b*".

According to another characteristic of the present invention, the rearmost part of the rear part 26*b* is shaped like the letter "U". In this U-shaped indentation 26*b*, a second pin 30, which runs across the rear-end mount 26 from left to right (in the direction perpendicular to the longitudinal direction of the piezoelectric element), is fitted. Like the first pin 28, the second pin 30 is also supported by the rear wall 12 of the housing. The second pin 30 is eccentric over its entire length except for the supporting parts at both ends. The head of the second pin is provided with a groove 32 for a screwdriver. The mounting angle of the U-shaped indentation 26*b* can be adjusted by turning the second pin 30, which is eccentric, and engaging it with the U-shaped indentation 26*b*. In this way, the position of the entire part of the rear-end mount 26 can be finely adjusted, making it possible to select the optimum bending motion. The second pin 30 is preferably formed with synthetic resin.

After the fine adjustment, it is preferable to coat and fasten this part with paint so that the head of the second pin 30 is not dislocated. If the head nonetheless becomes dislocated, the paint, which is by then dry, cracks, so it is possible to visibly check that the head has become dislocated and needs to be readjusted.

Although it is not necessary for the present invention, it is preferable to provide a first fastening screw (see FIGS. 1, 5, 6) between the first pin 28 and the second pin 30 in such a way that it is parallel to the first pin 28 and the second pin 30. After performing fine adjustment using the second pin 30, the first fastening screw 33 is fastened to fortify the position of the rear-end mount 26, thereby preventing dislocation. It is further preferable to prevent dislocation by using a second fastening screw 31 (see FIGS. 4, 5) in the direction perpendicular to the second pin 30.

At the rear-end mount 26, a terminal 36 is provided for electrically connecting the piezoelectric element to a conducting wire 34. Using this conducting wire 34, the upper and lower piezoelectric elements can be cross-connected (umpered). Specifically, the conducting wire is stripped in the middle leaving several millimeters covered on the side of the rear-end mount 26, and the stripped part is soldered to the upper piezoelectric element. The remaining part of the conducting wire, which is covered, crosses the upper and lower piezoelectric wires, while the end of the conducting wire is connected to the lower piezoelectric element. In this way, conductor connection and cross connection can be achieved with a single conducting wire.

The conducting wire 34 has preferably an insulation having a heat resistance up to 250° C. By constructing in this manner, these parts are resin-formed and covered at the same time as the piezoelectric element, resulting in high reliability. The other end of the conducting wire 34 is connected to a controller (not shown) via a feeding device. The controller comprises a memory device that stores a knitting procedure of the desired pattern and a device that applies a voltage to several piezoelectric elements based on the stored knitting procedure.

In the forward part of the piezoelectric element 6, there is a finger 8, which is made of hardened steel. The tip of the finger 8 protrudes from the front wall 10 of the housing. As shown in FIG. 2, the finger tip 40 has a parallel face 40*a* and a slanting face 40*b* that make contact with the butt (peg) of the jack, which is arranged so as to make contact with the knitting needle or the lower end of the knitting needle. Although not shown, the finger 8 can be provided with one or more holes to reduce its weight. By reducing the weight of the finger and maintaining its balance, the load on the piezoelectric element can be reduced while increasing the reaction speed. The finger rear-end 42 is supported by a rear-end mount 44. The rearmost part of the rear-end mount 44 has a U-shaped section. In the U-shaped indentation 44*a*, the tip 24*a* of the front-end mount 24 of the piezoelectric element is inserted.

Because the finger 8 is connected to the piezoelectric element 6 in this way, it is possible to move the rear-end part 44 vertically in the longitudinal direction using a third pin 46, which runs through the rear-end mount 44 from left to right (in the direction perpendicular to the longitudinal direction of the piezoelectric element), as a fulcrum. The third pin 46 is supported by the front wall 10, and a screw 47 prevents its rotation. At each third pin 46, two fingers 8 are provided. Thanks to this configuration, the number of the third pins 46 is half that of the fingers 8. The vertical motion of the finger 8 moves the butt (peg) of the jack arranged so as to make contact with the knitting needle or with the lower end of the knitting needle.

Yet another characteristic of the present invention is that the second pin 46 is provided with either a single or several spiral grooves 48 (most evidently shown in FIG. 2) over practically its entire length. The spiral groove 48 is about 1 mm wide and 0.3 mm deep. The functions of the spiral groove 48 are: preventing friction on the surface that makes contact with the finger, oiling, and removal of foreign matter.

Still another characteristic of the present invention is that two unpenetrated tapping holes 15 (see FIG. 1) are provided at the rear wall 12. The rear wall 12 has so many contacting points with the machine that removing it from the rest, as may be required when the machine needs repairs, is sometimes difficult. By applying the first screws 33, for example, and screwing them into each tapping hole 15, the rear wall 12 goes up and is easily removed.

According to the present invention, by adding flexibility to the piezoelectric element assembly, the volume of the housing can be reduced substantially. In addition, various small improvements also add up to an actuator for needle selection that is in no respect inferior to the two-point support or three-point support methods of the prior art.

What is claimed is:

1. An actuator using a piezoelectric element in a needle-selecting apparatus for a knitting machine comprising:

a piezoelectric element of which one end is fixed in a cantilevered fashion, and a voltage is applied to the piezoelectric element to cause it to move, a finger attached to the forward part of the piezoelectric element, said finger being moved by the motion of the piezoelectric element, a rear-end mount to which the piezoelectric element is fixed, and a front part of the rear-end mount being tapered towards the piezoelectric element.

2. An apparatus according to claim 1, in which the rear-end mount comprises a front part and a rear part, and said front part, which is smoothly and linearly tapered towards the piezoelectric element, is made of synthetic resin.

3. An apparatus according to claim 2, in which a groove extends between the rear part and the front part of the rear-end mount in the direction perpendicular to the longitudinal direction of the piezoelectric element.

4. An apparatus according to claim 2, in which the synthetic resin has a hardness of D55 to D85.

5. An actuator using a piezoelectric element in a needle-selecting apparatus for a knitting machine comprising:

a piezoelectric element of which one end is fixed in a cantilevered fashion, and a voltage is applied to the piezoelectric element to cause it to move, a finger attached to the forward part of the piezoelectric element, said finger being moved by the motion of the piezoelectric element, a rear-end mount to which the piezoelectric element is fixed, a U-shaped indentation provided at the rearmost part of the rear-end mount, and an eccentric pin that extends in the direction perpendicular to the longitudinal direction of the piezoelectric element being fitted in the indentation.

6. An actuator using a piezoelectric element in a needle-selecting apparatus for a knitting machine comprising:

a piezoelectric element of which one end is fixed in a cantilevered fashion, and a voltage is applied to the piezoelectric element to cause it to move, a finger attached to the forward part of the piezoelectric element, said finger being moved by the motion of the piezoelectric element, a rear-end mount to which one end of the length of the finger is fixed, a pin fixed to the rear-end mount, said pin extending in the direction perpendicular to the longitudinal direction of the piezoelectric element, and a spiral groove engraved over practically the entire length of the pin.

7. An apparatus according to claim 6, in which two fingers are established at each pin.

8. An actuator using a piezoelectric element in a needle-selecting apparatus for a knitting machine comprising:

a piezoelectric element of which one end is fixed in a cantilevered fashion, and a voltage is applied to the piezoelectric element to cause it to move, a finger attached to the forward part of the piezoelectric element, said finger being moved by the motion of the piezoelectric element, and at least two unpenetrated tapping holes at a rear wall.

* * * * *